United States Patent [19]

Hunley, Jr. et al.

[11] Patent Number: 5,012,833

[45] Date of Patent: May 7, 1991

[54] FREEZE-PROOF HYDRANT

[75] Inventors: Eugene C. Hunley, Jr., Rogers; Terry H. Jozwiak, Witter, both of Ark.

[73] Assignee: Amtrol Inc., West Warwick, R.I.

[21] Appl. No.: 535,479

[22] Filed: Jun. 11, 1990

Related U.S. Application Data

[62] Division of Ser. No. 414,452, Sep. 29, 1989, Pat. No. 4,971,097.

[51] Int. Cl.[5] ..... F16K 24/02; F16K 11/07

[52] U.S. Cl. ..... 137/15; 137/218; 137/307; 137/360; 137/454.2

[58] Field of Search ..... 137/15, 218, 307, 360, 137/454.2

[56] References Cited

U.S. PATENT DOCUMENTS

| | | | |
|---|---|---|---|
| 4,475 | 7/1871 | Race et al. | 137/307 X |
| D. 244,605 | 6/1977 | Ratnik | D23/12 |
| D. 282,099 | 1/1986 | Tropeano | D23/12 |
| D. 285,824 | 9/1986 | Anderson | D23/12 |
| D. 285,825 | 9/1986 | Anderson | D23/12 |
| 304,204 | 8/1884 | Kaiser | 137/307 X |
| 352,288 | 11/1886 | Bardo et al. | 137/307 |
| 607,413 | 7/1898 | Mathews | 137/307 |
| 1,091,210 | 3/1914 | Gauntt | 137/307 X |
| 1,124,455 | 1/1915 | Kemp et al. | 137/307 |
| 2,019,515 | 11/1935 | Waterous et al. | 137/307 X |
| 2,019,804 | 11/1935 | Waterous et al. | 137/307 |
| 2,688,976 | 9/1954 | Baker | 137/284 |
| 2,783,773 | 3/1957 | Rasch | 137/454.6 |
| 3,074,424 | 1/1963 | Pletcher et al. | 137/454.2 X |
| 3,076,474 | 2/1963 | Skomp | 137/307 |
| 3,104,554 | 9/1963 | Mueller et al. | 137/307 X |
| 3,131,711 | 5/1964 | Delaney | 137/186 |
| 3,158,170 | 11/1964 | Tubbs | 137/218 |
| 3,267,952 | 8/1966 | Pletcher et al. | 137/360 X |
| 3,267,956 | 8/1966 | Kline | 137/360 |
| 3,926,207 | 12/1975 | Anderson et al. | 137/281 |
| 3,943,963 | 3/1976 | Papacek | 137/283 |
| 3,943,967 | 3/1976 | Holt et al. | 137/454.5 |
| 3,952,770 | 4/1976 | Botnick | 137/360 |
| 4,078,574 | 3/1978 | Kosarzecki | 137/269 |
| 4,250,912 | 2/1981 | Knapp | 137/315 |
| 4,331,176 | 5/1982 | Parkison | 137/454.5 |
| 4,407,323 | 10/1983 | Neff | 137/454.2 |
| 4,821,762 | 4/1989 | Breneman | 137/218 |
| 4,821,765 | 4/1989 | Iqbal et al. | 137/270 |

*Primary Examiner*—Gerald A. Michalsky
*Attorney, Agent, or Firm*—Fisher, Christen & Sabol

[57] ABSTRACT

Process for replacing a cartridge in a housing of a freeze proof hydrant. A plunger within the cartridge is urged against a roller pin lodged in the cartridge. A first end of the cartridge is deformed away from a ridge in the housing. The cartridge is slid out of the housing and the first end of the replacement cartridge is deformed. The replacement cartridge is slid into place within the housing. The first end of the replacement cartridge expanded to capture the ridge in the housing.

11 Claims, 7 Drawing Sheets

FREEZE-PROOF HYDRANT

This is a divisional of application Ser. No. 414,452, of Eugene C. HUNLEY, Jr., et al., filed on Sept. 29, 1989, now U.S. Pat. No. 4,971,097.

BACKGROUND OF THE INVENTION

1. Field Of The Invention

The invention relates to freeze-proof hydrants having a removable cartridge therein. The invention also relates to freeze-proof wall hydrants and freeze-proof yard hydrants having a removable cartridge therein. The invention also relates to removable cartridges or subassemblies for such freeze-proof hydrants.

2. Background Art

Freeze-proof wall hydrants or faucets are known in the art. Freezeless faucets are mounted on the exterior of a building with the valve extending inwardly with respect to the building to a point where the valve is protected from freezing by the interior warmth of the building. The handle and nozzle are located on the exterior of the building. After extended use, various interior parts of the freezeless faucet often become worn and need replacement. The use of removable cartridges in freeze-proof wall hydrants or faucets are known.

U.S. Pat. No. 2,688,976 discloses a non-freezing hydrant which includes a housing for disposal below the frost line of the earth, a water supply pipe attached to the housing, a riser attached to the housing extending upwardly therefrom and an open head attached to the upper end of the riser having a laterally extending spout. A valve casing is fixed in the housing and has an axially extending bore. A conical shaped valve is movable into and out of the bore of the valve casing. A valve rod is attached to the valve and extends upwardly through the riser and open head. There is means for moving the valve rod and valve longitudinally. An elastic sleeve is concentrically disposed on the valve rod and in spaced relation to the rod and the riser and disposed in the riser. There is means for securing the lower end of the sleeve to the valve casing. A circular member in the upper end of the open head has means for attaching the upper end of the elastic sleeve thereto. There is means to hold the circular member in spaced relation to the valve. A cap is disposed on the head for supporting the circular member in the riser. There is means for directing the flow of water through the riser to the spout in the head on the outer side of the elastic sleeve. The valve casing, valve, valve rod and elastic sleeve are removable as a unit upon removal of the cap from the head and the valve casing from the housing.

U.S. Pat. No. 2,783,773 discloses a faucet having a faucet body with an annular valve seat therein and a faucet nut thereon. There is a valve replacement which includes a tubular cylindrical plug of uniform internal and external diameter, a gasket between one end of the plug and faucet valve seat, an annular flange on the inside of the plug intermediate its ends, and outlet ports in the plug between the flange and the other end of the plug. There is a valve stem in the plug having a valve washer in the one end of the plug and a head in the other end of the plug. There is a compression spring on the stem between the head and the flange for urging the washer against the flange, and a nut having a cylindrical external surface of the same diameter as the plug abutting the other end of the plug. There is also a ring secured by the faucet nut for retaining the cylindrical nut, and a handle stem threaded in the cylindrical nut and having an inner end arranged to bear against the head to unseat the washer from the flange when the handle stem is turned. A washer is secured on the inner end of the handle stem to prevent withdrawal of the handle stem from the cylindrical nut.

U.S. Pat. No. 3,131,711 discloses a water hydrant.

U.S. Pat. No. 3,926,207 discloses a yard hydrant designed to eliminate the standard drain hole in devices of this type. Water in the standpipe that previously drained to the outside when the hydrant is closed is collected in a storage reservoir established in the hydrant casing and is available therefrom for subsequent use. The reservoir exists between a sealed bottom end associated with valve means to the source of water supply and a movable top end defined by a sealing means, such as, cup washers, O-rings or the like, on a reciprocal standpipe whereby the size of the reservoir area is expanded with the closing of the valve means to accommodate the drain water and is reduced with the opening of the hydrant valve causing the stored water to pass through the standpipe and out of the hydrant nozzle with the incoming water. The standpipe, hydrant valve means and related parts establishing the reservoir chamber are so attached to the hydrant head that they can be conveniently withdrawn as a unit from the hydrant casing for repairs or maintenance.

U.S. Pat. No. 3,943,963 discloses a frostproof hydrant structure which includes an elongated casing adapted for connection at an inner end portion thereof with a freeze-protected fluid source and having an opposite outer delivery end portion which may be exposed to freezing conditions, and valve means within the casing adjacent to the inner end portion for controlling fluid flow from the fluid source to the delivery end portion. There is valve operating means accessible adjacent to the delivery end portion. The valve means include a valve seat body fitting replaceably within the inner end portion of the casing and a movable valve member cooperating with the valve seat body. There is means removably connecting the valve operating means to the outer end portion of the casing, and means coupling the operating means in a unitary assembly with the valve member and the valve seat body. This apparatus enables the operating means to actuate the valve member between valve open and valve closed positions relative to the valve seat body and enables insertion of the valve seat body and the valve member together into the casing and removal thereof together from the casing through the outer end portion of the casing as permitted by the unitary assembly with the operating means. The valve seat body includes an annular seat portion with which the valve member is engageable in closing relation. The valve operating means includes an actuating member attached to the valve member. There is a concentric guide on the body through which the actuating member extends for moving the valve member between valve open and closed positions relative to the valve seat portion. There is a shoulder in the casing against which the valve seat body engages. There is also biasing means acting between the guide and the actuating member to maintain an engagement bias of the valve seat body toward the shoulder.

U.S. Pat. No. 3,943,967 discloses a faucet having a cartridge employing a cam and plunger type of closure means adapted to regulate the flow of fluid therethrough. The plunger, which is in communication with the faucet inlet and is urged away from its seat by the incoming fluid, is restricted in movement by a cam cooperating with a handle to thereby regulate the flow of fluid through the faucet.

U.S. Pat. No. 3,952,770 discloses a wall hydrant which includes a wall-penetrating straight tubular conduit, a valving member movable axially in and out of sealing engagement with a reduced inlet connection valving bore, and a hollow cylindrical end casting on the conduit outer end providing a lateral conduit outlet opening from a discharge bore. There is a plug in the outer casting end having a threaded aperture with a key-rotated stem threaded therethrough connected with a shaft to axially shift, upon rotation, the valving member moved by the shaft inner end and a shaft-carried flange slideably O-ring sealable on an interior surface controlling exterior draining and air vent openings associated with the plug. The valving and flange seals are spaced, relative to the controlling surface and inlet bore spacing, for conduit drainage and vent opening after inlet closure. There is, in combination with the hydrant, a wall box, a vacuum breaker and air inlet device. The air inlet device includes an integral enlargement on the casting outlet, a cap secured thereon with a hose connection as the hydrant final discharge and having air vents, a molded flexible elastomeric hollow element with cylindrical and open-ended conical inner end portions fitted into the mating enlargement end and having a conical outer end portion in the cap normally sealing the vents, and a member with a head within the flexible element shiftable outwardly with water flow against the outer conical portion to increase vent sealing pressure and gravitationally biased back toward the inner conical portion. The head is plurally through-apertured at locations radially inward of vent closing seal contact. The inner portion has a spacer formation preventing aperture closure by head contact therewith. The outer conical end of the molded element is flexible inwardly to open the vents, and on further flexing to seal upon a head outward projection. With the head gravitationally moved against the space and the other end sealed by the element, back flow is prevented and the air vents opened for hose drainage and/or vacuum breaking.

U.S. Pat. No. 4,078,547 discloses a modular hydraulic valve which includes a valve manifold and a number of valve cartridge elements disposed at least partly within cavities defined in the valve manifold. To encourage interchangeability and reduce manufacturing costs, each cavity includes a number of axially aligned steps of progressively decreasing diameter. The outermost step of each cavity is defined by a diameter identical with the outermost step diameter of all other cavities, regardless of whether those other cavities define one or more than one additional step. Likewise, the second outermost step in each cavity is defined by another diameter which is substantially identical with the second step diameter of all other cavities having two or more steps.

U.S. Pat. No. 4,250,912 discloses a faucet with an extractable cartridge enclosing two plates sliding at mutual contact for the control of the water flow. The envelope of the cartridge is inserted in the faucet body in non-rotatable manner but with a possibility of axial displacement, and a shoulder of a rotatable portion of the cartridge abuts against the internal surface of a cover, in view of avoiding need for preloading springs and for severe working tolerances. Both internal plates are identical with one another. A window in the envelope of the cartridge and a recess in the rotatable portion thereof cooperate in throttling the flow in the intermediate control positions.

U.S. Pat. No. 4,331,176 discloses a replaceable cartridge valve assembly adapted for use in a sanitary fitting which includes a pair of discs, each disc having at least one opening or orifice therein to provide the valving function and an auxiliary valve means. The valve assembly is made in the form of a removable cartridge and includes an arrangement of the valve stem which cooperates with an opening in the cartridge housing to provide the auxiliary valve means for throttling downstream from the at least one disc orifice of the disc valve means to provide a stepdown in pressure drop and thereby inhibit and/or reduce cavitation and other objectionable noises.

U.S. Pat. No. 4,407,323 discloses a three-way, normally closed only, pilot air valve for supplying pressurized pilot air to a directional flow control air valve, such as, a four-way valve, a three-way valve, a two-way valve or the like, for shifting the main valve spool of such valves. The valve includes a valve body having a pilot air inlet port, a cylinder port, and an exhaust port. A tubular valve retainer member having an axial bore formed therethrough is releasably mounted in the valve body. A first passageway connects the pressurized pilot air inlet port to the cylinder port. A second passageway connects the cylinder port with the exhaust port. A captive poppet valve spool is movably mounted in the valve retainer member for controlling the flow of air through the two passageways.

U.S. Pat. No. 4,821,762 discloses a freezeless wall faucet having a removable cartridge. An elongated housing has a bore extending therethrough with an inlet end at one end and an outlet nozzle at the other end. A removable cartridge is inserted within the bore and includes the valve assembly and the handle and operating rod for moving the valve assembly. The entire working valve assembly and operating rod can be removed as a unit for replacement of O-rings or other parts. A back flow preventor is provided within the housing.

U.S. Pat. No. 4,821,765 discloses a removable cartridge type valve which has a minimum number of parts yet affords right and left hand conversion for cold and hot water usage in the same valve. A cross-shaped groove is provided on the top of the movable disk, and the stem selectively is inserted into one or the other arm of the groove. The valve also provides a secure fitment of the valve stem in the valve body through the use of a grooveless-type retaining member. Further, any tendency for bottom gasket members to be forced down out of the valve housing is eliminated by the use of an L-shaped gasket. Binding is also reduced by thinning the gasket adjacent to the intersection of the arms of the "L" on the gasket.

Reference is also made to U.S. Design Pat. Nos. D-244,605, D-282,099, D-285,824 and D-285,825.

BROAD DESCRIPTION OF THE INVENTION

An object of the invention is to provide freeze-proof hydrants having a removable cartridge therein. Another object of the invention is to provide freeze-proof wall hydrants and freeze-proof yard hydrants having a removable cartridge therein. Another object is to provide removable cartridges or subassemblies for such freeze-proof hydrants. Other objects and advantages of the invention are set out herein or are obvious herefrom to one skilled in the art.

The objects and advantages of the invention are achieved by the hydrants, hydrant (cartridges) subassemblies and processes.

The invention involves freeze-proof (or frost-proof) hydrants having removable (or extractable) cartridges. The removable cartridge is a readily replaceable valve seat-valve assembly. Or, in other words, the valve assembly is a fully replaceable valve mechanism cartridge. The design of the replaceable cartridge allows the water flow to pass through the plunger rather than bypass it in the open position. The invention involves freeze-proof wall hydrants which include: (a) a housing having first and second ends, the first end having fitting means adapted for flow communication with a source of liquid under pressure; (b) passageway in housing (a) for flow of the liquid from the first end to the second end of housing (a); (c) back flow preventer means located in passageway (b) and (d) drain means in housing (a). There is (e) a removable cartridge located in passageway (b) between back flow preventer means (c) and the first end of housing (a), which includes: (i) a casing having a first end having an opening and a second end having an opening; (ii) a passageway in casing (i); (iii) drain means in casing (a) comprising a drain channel and at least one hole in the drain channel which extends through casing (a); (iv) means for retaining removable cartridge in passageway (b); and (v) plunger means in passageway (ii) which can be moved from an open or liquid flowing position to a closed or liquid draining position, and vice versa, the plunger means having a plunger head which blocks passageway (i) in the closed position and which allows liquid flow in passageway (i) in the open position; the plunger means having a body to which the plunger head is connected, the plunger body having at least one passageway therethrough for liquid flow, the plunger means blocking drain means (d) and drain means (iii) when in the open position, and there being communication between drain means (iii) and drain means (d) when the plunger means is in the closed position. The hydrant also includes: (f) valve operating means, located in housing (a) so as not to block the liquid flow in passageway (b), whereby plunger means can be moved between the open position and the closed position.

The design of the invention freeze-proof or frost-proof hydrant can be utilized in any hydrant in which the operating handle (or lever) and valve mechanisms are physically separated by a space determined to be sufficient to prevent exposure to freezing (water) temperatures.

The unique features of the invention are (a) primarily a fully replaceable valve mechanism cartridge, and (b) the cartridge, factory assembled, can be installed or replaced without disturbing the piping connection of the hydrant or its surrounding wall or earth placements.

Many known freeze-proof hydrants, both wall and yard types, use a rubber plunger on the end of an operating rod, which pushes against a seat to compress the rubber to a pressure level higher than the water pressure to be sealed. The seating surface is either machined directly into the valve outer body casting or is a seat which is threaded into the machined valve body. When pressure cutting, abrasive wear or damage to the seating surface occurs, the entire valve body must be removed from its piping installation to either replace the seat or entire valve body, which requires removal from the wall in the case of a wall hydrant, or digging up a buried pipe line.

In the invention freeze-proof hydrant, the plunger and seating surface are preferably composed of NSF-approved plastic and are assembled into a cartridge which can be removed and replaced without disturbing the hydrant piping connections whatsoever at any depth. In addition, the plunger effects its seal by the entry and exit of a plug into a smooth, molded bore sealed by an O-ring. For installation of the invention cartridge, a simple axial force is applied to the operating rod to deflect the snaps until they engage the shoulder in the valve body. For later removal, preferably a pulling force approximately 10 times the installation force (preferably: 25 pounds for installation/300 pounds for removal) is required. This pulling force is achieved using the leverage or screw lead advantage of the hydrant components already available in the hydrant assembly itself. Tools required would be channel-lock pliers or pipe wrench, or crescent wrench and a flat blade screwdriver.

The invention freeze-proof hydrant cartridge allows the water flow to pass through the plunger rather than bypass it in the open position. In this use in a yard hydrant, the drain access bleed port is isolated by this style flow-through plug by using O-rings on its outside wall. In the closed position, the plug is moved downward to expose two opposing drain holes which open into a channel around the outside wall of the cartridge outer sleeve. This channel is, thus, an open path to the drain port which is the exit path from which the water from the yard hydrant column drains into the earth drain field. The channel, which extends completely around the sleeve circumference, allows random angular orientation of the cartridge assembly into the valve outer body casting, and is itself isolated from the rest of the system of O-rings which seal between each end of the inside wall of the valve outer body and the sleeve. Two opposing drain holes assure a positive drain path for the water column and also assure, with random angular location, that at least one drain port is never further away from the drain port opening by more than 90 degrees through the outer body.

In addition, prior to removal of the cartridge, a turning action on the operating rod of the hydrant and the pulling of the cartridge, allows the scrubber/wiper rings on the sleeve to clean the metal valve body to prepare it to accept the new cartridge.

After extended use, various interior parts of freeze-proof hydrants become worn and need replacement. The freeze-proof hydrants of the invention have removable cartridges which are easily replaced.

The invention encompasses both residential and commercial freeze-proof hydrants (faucets).

The invention involves removable cartridges for freeze-proof hydrants. The removable cartridges include:

(i) a casing having a first end having an opening and a second end having an opening;

(ii) a passageway in casing (i);

(iii) drain means in casing (a) comprising a drain channel and at least one hole in the drain channel which extends through casing (a);

(iv) means for retaining removable cartridge in passageway (b);

(v) plunger means in passageway (ii) which can be moved from an open or liquid flowing position to a closed or liquid draining position, and vice versa, the plunger means having a plunger head which blocks passageway (i) in the closed position and which allows liquid flow in passageway (i) in the open position; the plunger means having a body to which the plunger head is connected, the plunger body having at least one passageway therethrough for liquid flow, the plunger means blocking drain means (iii) when in the open position, and there being communication between drain means (iii) when the plunger means is in the closed position.

BRIEF DESCRIPTION OF THE DRAWINGS

In the drawings:

FIG. 3 is a longitudinal cross-sectional view of the installed cartridge of the invention in the closed or water draining position;

The materials used in the invention hydrants must be those which allow fulfilment of the functions of each of such materials and which are durable under the conditions of use of the hydrants. The plunger and seating surface of the valve is composed of an NSF-approved plastic.

DETAILED DESCRIPTION OF THE INVENTION

Figure 6:
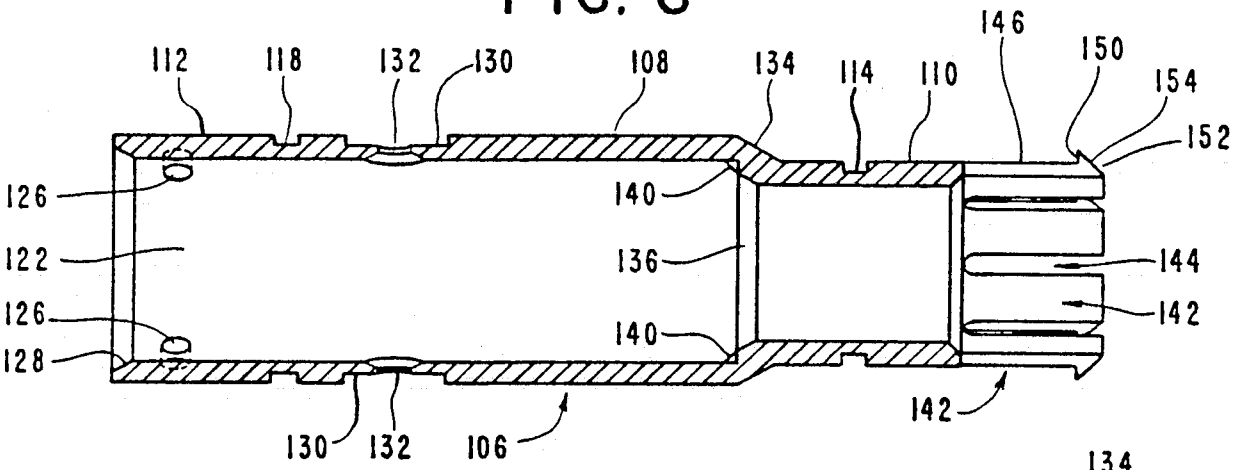
FIG. 6 is a longitudinal cross-sectional view of the most preferred embodiment of the cartridge casing.
Figure 8:
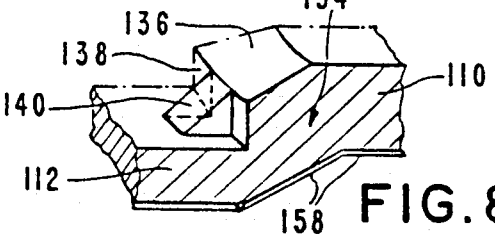
FIG. 8 is a cross-sectional, perspective view of the transitional portion of the cartridge casing of FIG. 6.
Figure 7:
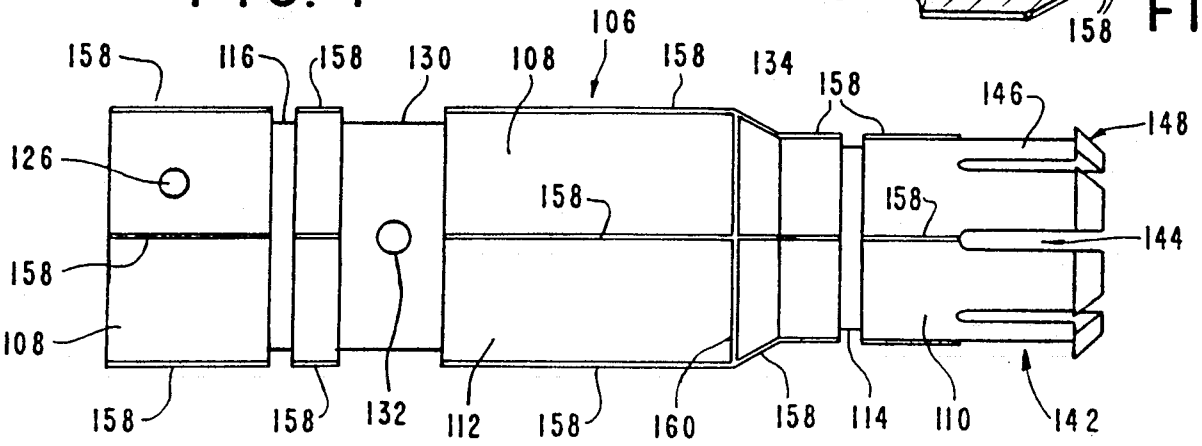
FIG. 7 is a side view of the cartridge casing of FIG. 6.

Removable valve mechanism cartridge 106 has casing (or housing) 108 (which is also termed valve cartridge sleeve 108). Reference is made to FIGS. 6 and 7. Front portion 110 of casing 108 has a smaller diameter than does back portion 112 of casing 108. O-ring gland (or groove) 114 is located in front portion 110 of casing 108. O-ring 116 is located in O-ring gland 114 (see FIG. 2). O-ring gland 118 is located in the back region of back portion of casing 108. O-ring 120 is located in O-ring gland 118 (see FIG. 2). Central passageway 122 traverses the entire length of casing 108. Roll pin 124 removably fits in a tight manner in holes 126 in the back region of back portion 112 of casing 108 (see FIGS. 2 and 6). Holes 126 are offset from the longitudinal axis of central passageway 122 and are located beyond O-ring gland 118. Inner surface 128 of the end of back portion 112 of casing 108 is bevelled. Drain channel 130 is located circumferentially in the outer surface of back portion 112 of casing 108 inwardly of O-ring gland 118. Two drain holes 132 are located diametrically opposite of each other in the bottom wall of drain channel 130—this 180° location to each other is preferred. (Also the use of three or four equally spaced drain holes 132 is preferred.) Drain holes 132 provide communication between drain channel 130 and central passageway 122. The preferred embodiment of transition portion 134 between front portion 110 and back portion 112 of casing 108 is best seen in FIG. 8. Transition portion 134 is of slanted shape between front portion 110 and back portion 112. The inside of transition portion 134 has slanted portion 136, which extends to about the end of back portion 112 of casing 108. The inside of transition portion 134 continues with vertical wall 138, which connects the inner end surface of back portion 112 and slanted portion 136 of transition portion 134. Two blocks 140, having a right angle triangular cross-section, are located in the L-shaped angle formed by vertical wall 138 and the end of back portion 112. Blocks 140 are located diametrically to each other and in the same longitudinal plane in which drain holes 132 are located. Blocks 140 are integral parts of casing 108. The front surfaces of blocks 140 are generally a continuation of the slanted surface of slanted portion 136 of transition portion 134, but at a slightly steeper slant. The end portion of front portion 110 of casing 108 contains eight spring fingers 142 for snap-in installation (any other suitable number of spring fingers 142 can be used). Slots 144 are located between spring fingers (extensions) 142. Spring fingers 142 contain elongated portions 146, which are thin enough to be slightly flexible, and end portions 148, which are outwardly-extending and angle-shaped with flat surfaces 150 and reverse slanted surfaces 152 forming outwardly-oriented triangles 154. Flat surface 150 is located in a plane which is perpendicular to the longitudinal axis of casing 108. Bevelled inside surface 156 is formed since elongated portions are thinner than front portion 110 of casing 108.

Figure 2:
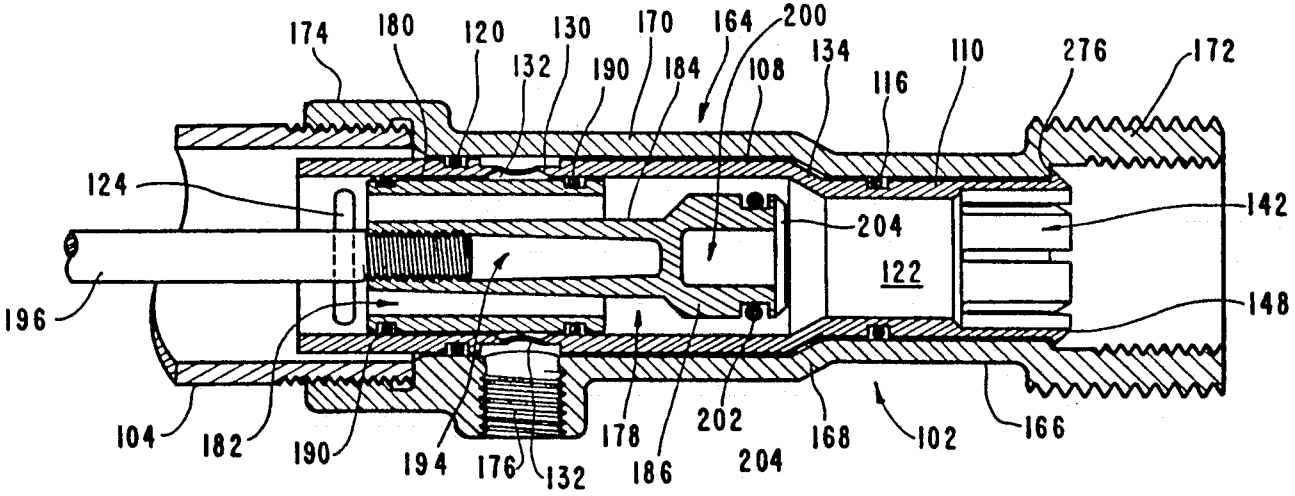
FIG. 2 is a longitudinal cross-sectional view of the installed cartridge of the invention in the open or water flowing position.
Figure 3:
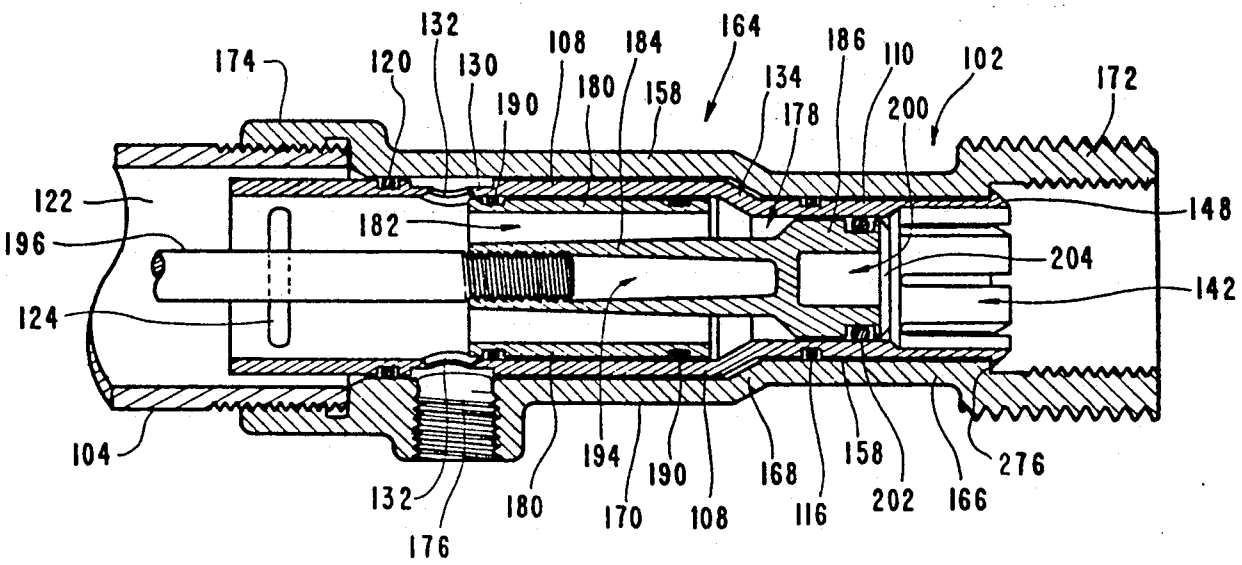
FIG. 3 is a longitudinal cross-sectional view of the installed cartridge of the invention in the closed or water

In another embodiment of transition portion 134, reference is made to FIGS. 2 and 3. The inside of transition portion 134 is one continuous slanted surface.

Figure 11:
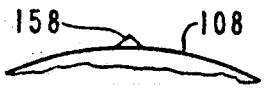
FIG. 11 is a cross-sectional view of a scrubber ring on a portion of the cartridge casing of FIG. 6.
Figure 10:
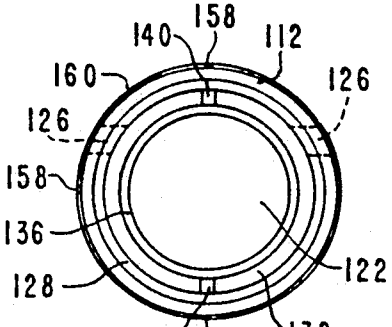
FIG. 10 is a bottom view of the cartridge casing of FIG. 6.

As best seen in FIG. 7, scrubber ribs 158 and scrubber ring 160 are located on the outside of casing 108. Scrubber ribs 158 and scrubber ring 160 are composed of hard but flexible rubber and are generally triangular in cross-section. See FIG. 11, which shows a cross-section of scrubber rib 158. Preferably each side of scrubber rib 158 (and scrubber ring 160) has a slant of 60 degrees to the perpendicular. Preferably there are four molded scrubber ribs 158 positioned longitudinally at 90 degrees apart. Each scrubber ring 158 extends to the bottom of a slot 144. Scrubber ring 160 is preferably located at the front end of back portion 112 at the rim formed by back portion 112 and transition portion 134.

Figure 1:
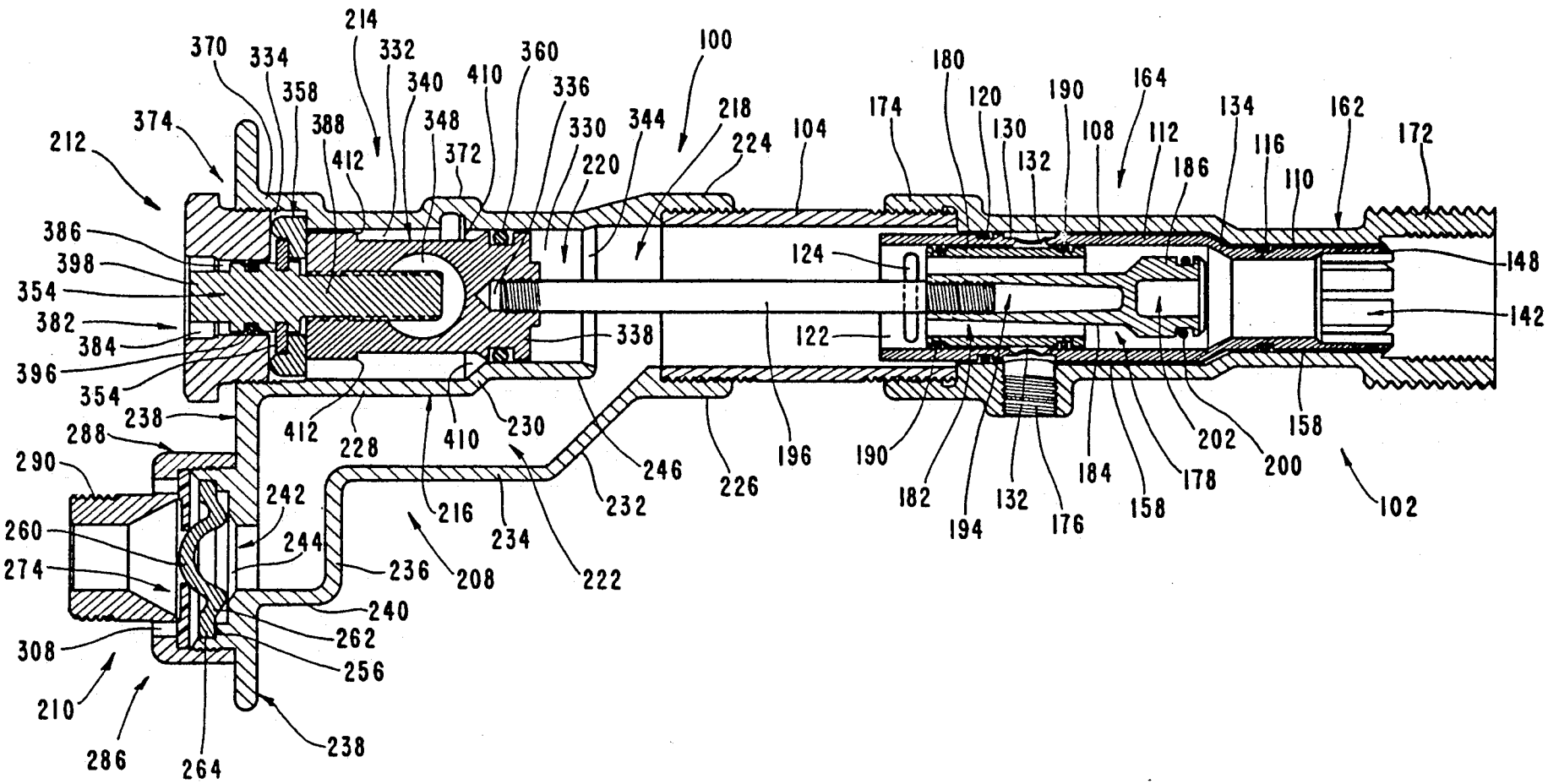
FIG. 1 is a longitudinal cross-sectional view of the preferred embodiment of the freeze-proof wall hydrant of the invention.

As shown in FIG. 2, cartridge casing 108 fits in outer valve body (casing) 162 of valve portion 102 of freeze-proof hydrant 100. Outer valve body 162 can be made of any suitable material, such as, brass, iron or plastic. Middle section 164 of outer valve body 162 generally has the same inner shape as the outer shape of cartridge casing 108 to provide a tight fit between cartridge casing 108 and middle section 164 while still allowing insertion and removal of valve mechanism cartridge 106. Accordingly, middle section 164 has front portion 166, slanted transition section 168 and back portion 170. Front portion 166 has a smaller diameter than does back portion 170. Outer valve body 162 has front section 172 and back section 174. Front section 172 has a larger diameter than front portion 166 of middle section 164, forming flat inner rim 276 therebetween. When valve cartridge 106 is in place in outer valve body 162, end portions 148 of spring fingers 146 ar positioned within front section 172 with flat surfaces 150 of end portions 148 in contact with inner rim 166. This arrangement keeps valve mechanism cartridge 106 in place in outer valve body 162. Front section 172 is internally and externally threaded for attachment to the water source (not shown), the end of which is positioned in a wall (not shown), depending upon whether the end of the water source is externally or internally threaded and its size. In FIG. 1, the end of freeze-proof wall hydrant 100 which corresponds to section 172 of outer valve body 162 is termed the front end thereof and the other end of freeze-proof wall hydrant 100 is termed the back end thereof. Rear section 174 has a larger diameter than rear portion 170 of middle section 164. Rear section 174 is internally threaded. The rear end of casing 108 extends beyond the end of rear section 174. The front end of cylindrical extender 104 is externally threaded so it can be screwed into rear section 174. Cylindrical extender 104 has a larger diameter than casing 108. Drain port 176 is located in the bottom of the rear portion of middle section 164 at a position which coincides with drain channel 132 of casing 108. When not in use drain port 176, which is internally threaded, is blocked by an externally threaded plug or cock (not shown). A cock key (not shown) can be used to remove or tighten the cock.

Figure 14:
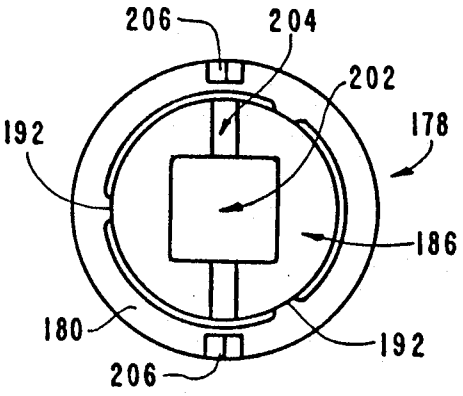
FIG. 14 is a top view of the plunger of FIG. 12.
Figure 15:
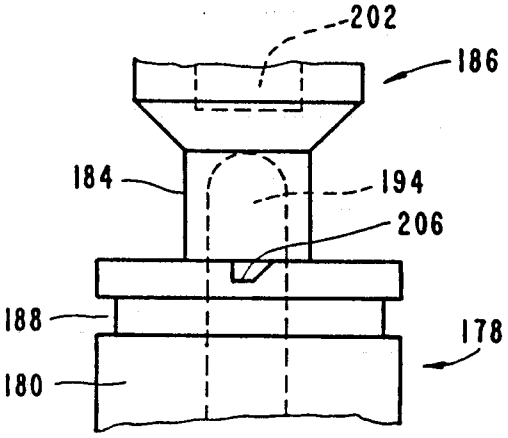
FIG. 15 is a partial side view of the plunger of FIG. 12.
Figure 12:
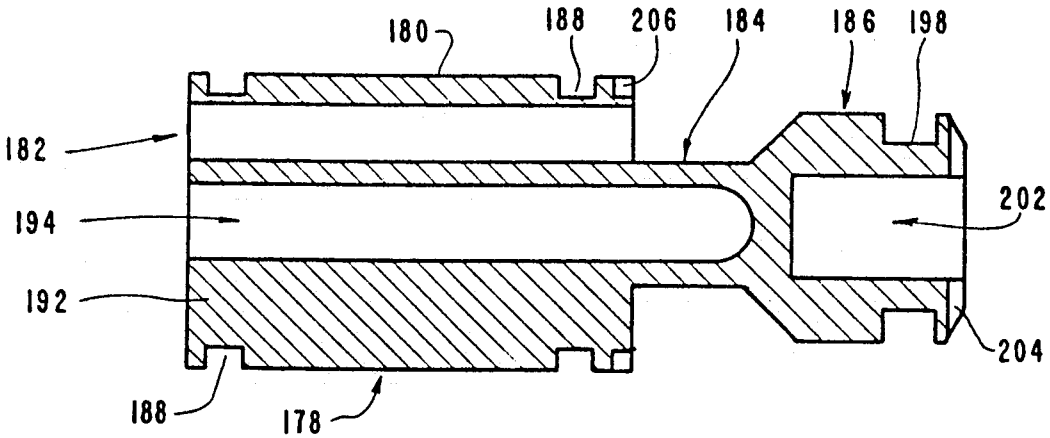
FIG. 12 is a longitudinal cross-sectional view of the plunger along lines A—A FIG. 13.
Figure 16:
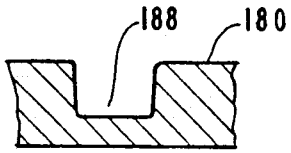
FIG. 16 is that portion of the cross-sectional view of FIG. 12 showing one of the O-ring glands.
Figure 13:
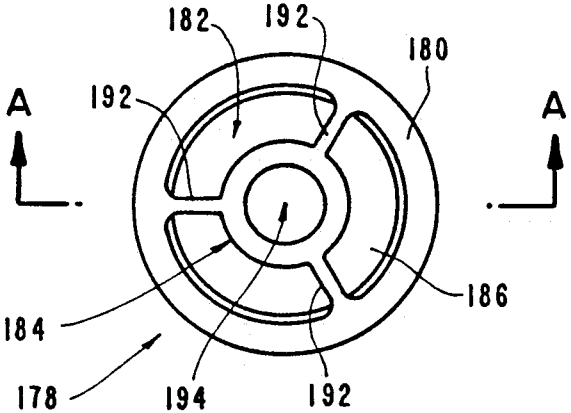
FIG. 13 is a bottom view of the plunger of FIG. 12.
Figure 18:
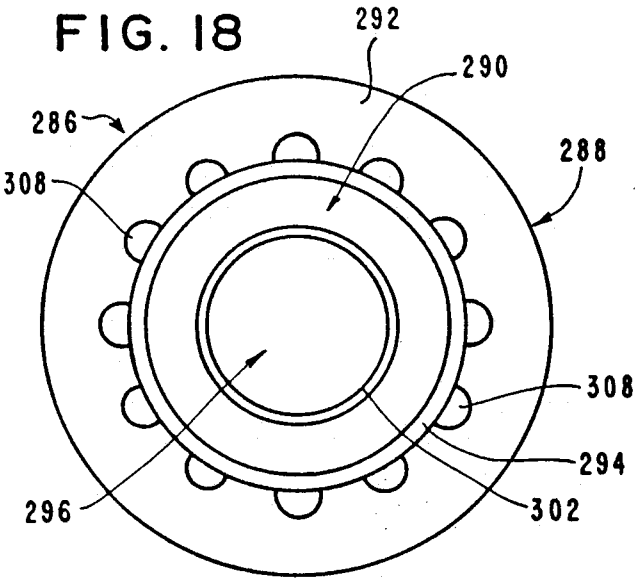
FIG. 18 is a top view of the back flow preventer of FIG. 17.
Figure 27:
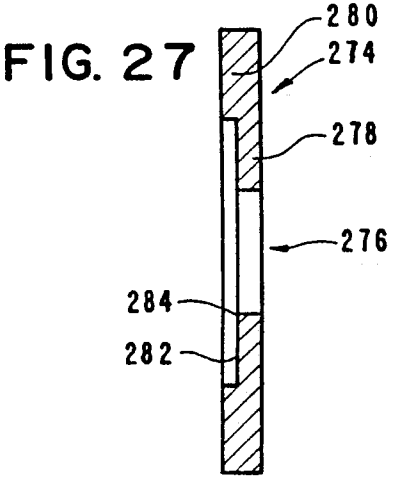
FIG. 27 is a longitudinal cross-sectional view of the diverter diaphragm of the backflow preventer of FIG. 4 or 17.
Figure 20:
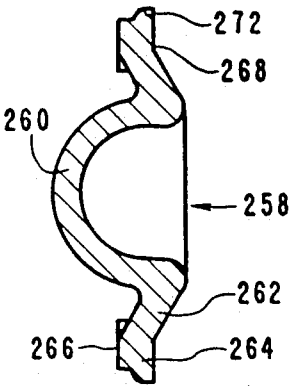
FIG. 20 is a longitudinal cross-sectional view of the diverter check spider of FIG. 19.

Referring to FIGS. 2 and 3, plunger 178 is shown within casing 108. Plunger 178 is best seen in FIGS. 12 to 14. Plunger 178 contains base 180, which has central bore 182, shaft portion 184 and plunger head 186. O-ring glands 188 are located at the front and back portions of base 180. FIG. 16 shows the details of one of O-ring glands 188. FIGS. 2 and 3 show O-ring 190 in place in O-ring glands 188. Shaft portion 180 lies on the longitudinal axis of base 180 (bore 182). Ribs 192 (three in equidistant relationships are shown) affix shaft portion 180 to base 184 in bore 182—see FIG. 13. Shaft portion 180 contains central bore 194 (only open on the rear end), the lower end of which is threaded. The threaded front end of operating rod 196 is screwed into the threaded rear end of bore 194. Plunger head 186 is mounted on the front end of shaft portion 184 and is on the same axis as the latter. Plunger head 186 is slightly smaller in diameter than bore 182. O-ring gland 198 is located near the front of plunger head 186. FIGS. 2 and 3 show O-ring 200 in place in O-ring gland 198. Square-shaped holes 202 (other shapes can be used) is located in the top of plunger head 186. A square-ended wrench can be placed in hole 202 to assist in screwing operating rod into bore 194. Groove 204 in the top of plunger head allows the use of a flat blade screwdriver for the same purpose. Slip grooves 206 also allow the use of channel-lock pliers for the same purpose.

As shown in FIG. 2, when plunger 178 is in the open or water flowing position, drain channel 130 and drain holes 132 lie between O-rings 190, and plunger head 186 is positioned in the rear portion of central bore 122 (of casing 108). As shown in FIG. 3, when plunger 178 is in the closed or water draining position, drain channel 130 and drain holes 132 do not lie between O-rings 190, and plunger head 186 is located in the front portion of central bore 122 (of casing 108) in a tight, sealing manner, while still allowing ready insertion and removal of plunger head 186.

Figures 4, 5:
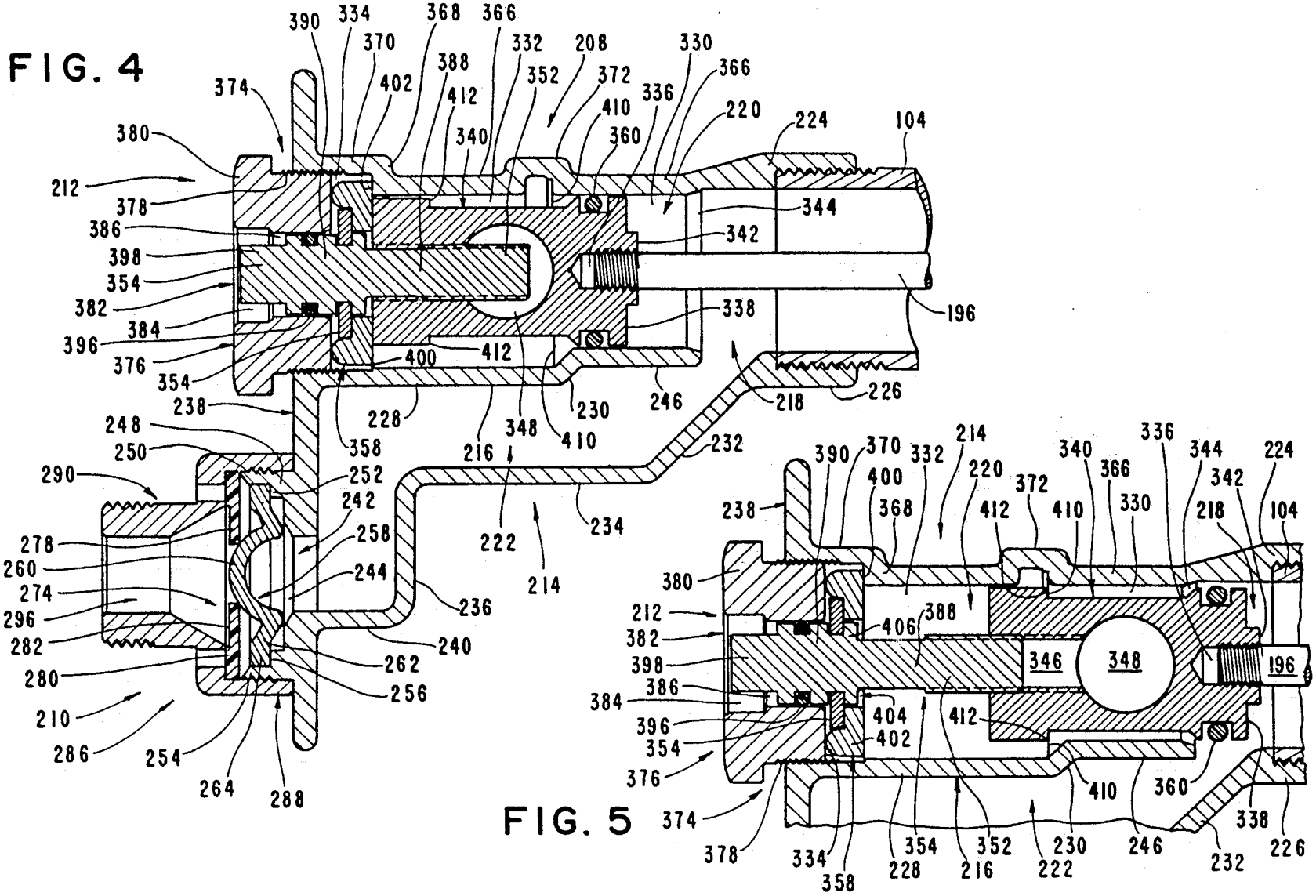
FIG. 4 is a longitudinal cross-sectional view of the backflow preventer of the invention and operating handle mechanism of the invention in the open position in a unitary housing.
FIG. 5 is a cross-sectional view of the operating handle mechanism of the invention in the closed position.
Figure 9:
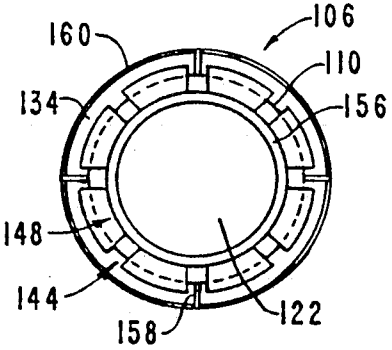
FIG. 9 is a top view of the cartridge casing of FIG. 6.

As shown in FIGS. 1 and 4, subassembly 208 is primarily composed of back flow preventer 210 and operating handle mechanism 212 basically in a single, unitary housing (214) with separating wall 216. Housing 214 has three chambers, namely, front chamber 218, top chamber 220 and bottom chamber 222. Front chamber 218 has a cylindrical shape, and is shaped by top wall portion 224 and bottom wall portion 226 of housing 214. The front end portion of front chamber 218 is internally threaded. The rear end portion of cylindrical extender 104 is externally threaded so it can be screwed into front chamber 218 of housing 214 (see FIG. 1). Separating wall 216 has back wall segment 246. Bottom wall segment 226 slants downwards (232) to form (with front wall segment 230) a communication passageway between front chamber 218 and bottom chamber 222. Bottom wall segment 226 continues horizontally (234) parallel to back wall segment 228, then vertically (236) parallel to wall 238 of housing 214, and finally horizontally (240) to rear wall 238. This description must, of course, take into consideration that FIG. 4 is a longitudinal cross-sectional view and that housing 214 has sides and some of its parts are curved in the plane perpendicular to the longitudinal axis. Circular passageway 242 is located in rear wall 238 just above wall portion 240 of bottom wall segment 226. Passageway 242 provides communication between bottom chamber 222 and the outside of rear wall 238. The outside edge of passageway 242 is bevelled (244).

Figure 19:
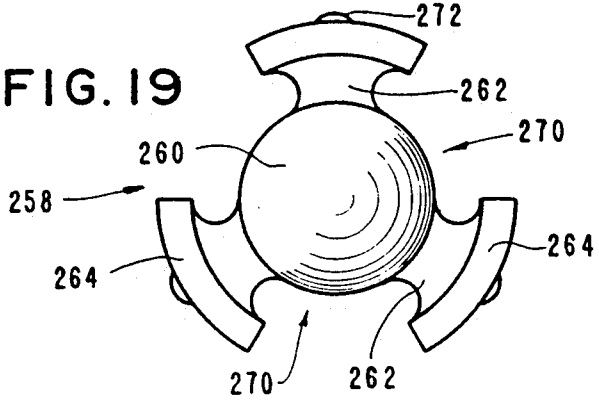
FIG. 19 is a top view of the diverter check spider of the backflow preventer of FIG. 4 or 17.
Figure 25:
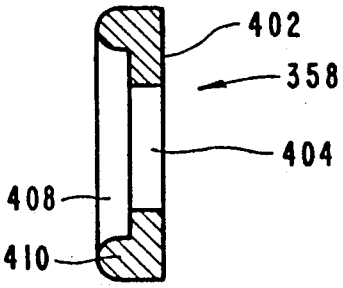
FIG. 25 is a longitudinal cros-sectional view of the retainer seal.
Figure 26:
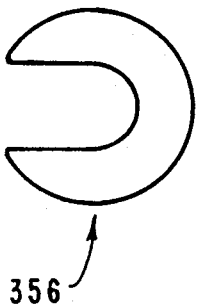
FIG. 26 is is a tip view of the thrust washer.

Cylindrical extension 248 on the outside of rear wall 238 is externally threaded and is positioned on the longitudinal axis of passageway 242. The inside lip of cylindrical extension is bevelled (250). Internal front segment 252 of cylindrical extension 248 is of smaller diameter than internal back segment 254 to form a step having flat rim 256. Diverter diaphragm 258 is positioned in cylindrical extension 248 as shown in FIG. 4. Diverter diaphragm 258 is composed of a flexible material, such as, a hard rubber. Referring to FIG. 19, diverter diaphragm 258 has central dome 260 and three arms 262. The top of dome 260 faces outwards. Arms 262 form wide slots 270. Each leg 262 slants upwards and outwards, having curved head 264 on the outer end thereof. Curved heads 264 are arc-shaped, and have flat top surfaces 266 and flat bottom surfaces 268. The flat bottom surfaces 268 are positioned in contact with flat rim 256. Rounded extensions 272 of heads 264 contact the inside wall of cylindrical extension 248, thereby keeping diverter diaphragm 258 from moving laterally within cylindrical extension 248. Diverter diaphragm 274 is round and composed of a flexible material, such as, a silicone rubber. Diverter diaphragm 274 has central passageway 276. Internal front segment 278 of diverter diaphragm 274 is of smaller diameter than internal back segment 280 to form a step having flat rim 282. Diverter diaphragm 274 is positioned on the outer rim of cylindrical extension 248. The top of dome 260 extends into the portion of central passageway 276 formed by internal front segment 274 of diverter diaphragm 274. The external surface of dome 260 sealingly contacts front rim 284 of internal front segment 274.

Hose piece 286 has cap segment 288 and cylindrical extension 290 extending from top surface 292 of cap segment 288. A hose (not shown) or the like can be screwed onto cap segment 288, which is externally threaded (294). Passageway 296 longitudinally extends through hose piece 286. Passageway segment 298 of passageway 296 is located inside of cylindrical extension 290. Passageway segment 300 of passageway 296 is located inside of cap segment 288. The inside back rim of cylindrical extension 290 is bevelled (302). The inside front rim of cylindrical extension 290 is extensively bevelled (304), forming narrow flat rim 306. Bevel 304 is typically 30 degrees. Twelve holes 308 are located in top surface 292 of cap segment 288. Holes 308 are flush against the outside of cylindrical extension 290. Holes 308 are equidistant from each other. Holes 308 provide communication from passage segment 300 to the atmosphere. The top portion (310) of the inside side surface of cap segment 288 extends inwardly with flat vertical surface 312 and flat horizontal surface 314. Flat horizontal surface 314 is located on the circle formed by the inside of holes 308. The bottom region of the inside wall of cap segment 288 is threaded (316). When hose piece 286 is screwed onto externally-threaded cylindrical extension 248, flat vertical surface 318 contacts and slightly compresses the outer rim portion of diverter diaphragm 274.

Figure 17:
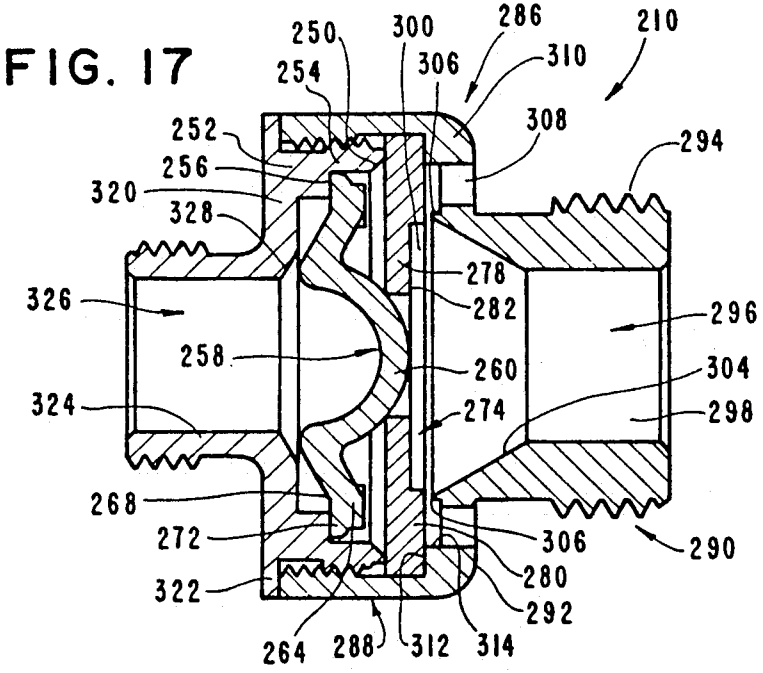
FIG. 17 is a longitudinal cross-sectional view of the invention backflow preventer that is screwed into the body casing.

FIG. 17 shows a version of back flow preventer 210 which is screwed into an internally-threaded passageway (not shown) in front wall 238 which corresponds to passageway 242. In this embodiment of back flow preventer 210, cylindrical extension 238 is not on the outside of rear wall 238, but instead is on bottom plate 320. The bottom of cap segment 288 contacts the top of outer rim 322 of bottom plate 322. Adapter piece 324 is mounted on bottom plate 322. Adapter piece 324 is externally threaded and screws into the above-noted internally-threaded passageway in front wall 238. Central passageway 326 in bottom plate 322 and adapter piece 324 provides communication between lower chamber 122 and passage segment of passageway 296 in cap segment 288. The back rim of central passageway 326 is bevelled (328). In back flow preventer 210 of FIG. 17, rim 306 extends below the rest of front surface of top surface 292.

While back flow preventer 210 is preferred, any suitable or conventional back flow preventer can be used in place of it. The back flow preventer (210) shown in the drawings is basically that of U.S. Pat. No. 3,850,190.

In operation, water flows from the pressurized water source (not shown) into the front end valve case body 162 and into the front portion of central passageway 122. Referring to FIG. 1, wherein plunger 178 including plunger head 186 are in the open or water flowing position, the water flow continues around plunger head 186, and into and through passageways 182 in base 180. The water flow continues through cylindrical extension 104, down through lower chamber 122 and through passageway 242 in back wall 238. Referring to FIG. 4, the water flow continues into the lower portion of passage 296 in cap segment 288, the passageway formed by bevelled rim portion 328 and the bottom rim of dome 260, through slots 270 and into the lower portion of passageway segment 300. The water pressure forces open the end of segment 278 of diverter diaphragm 274, allowing the water flow to continue into passageway segment 300 and then through passageway segment 298 of passageway 298. When the water flow is turned off, the end of segment 278 returns to seating engagement with dome 260. During water flow conditions, the top surface of inner segment 280 of diverter diaphragm 274 is forced against flat rim 306 of cylindrical extension 290, thereby preventing water from flowing out holes 308. The embodiment of back flow preventer 210 in FIG. 17 operates in a similar manner.

Any back pressure, during water flow through freeze-proof wall hydrant 100 or during static water conditions or reduced water pressure in freeze-proof wall hydrant 100, is prevented passage or back flow by back flow preventer 210. The backwards water flow caused by the back pressure is stopped and prevented by dome 206 and diverter diaphragm 274. The back pressure against diverter diaphragm 274 forces end segment 278 against dome 260 causing an even tighter seal therebetween. Even if the back pressure against dome 260 forces inwardly, the bottom rim of dome 260 is forced back against bevelled rim segment 328 and end segment 278 maintains its tight seal against dome 260.

The back pressure is immediately dissipated as it occurs because water is diverted out of passageway segment 300 (and passageway segment 298) into the passageway between the top surface of inner segment 280 of diverter diaphragm 274 and flat rim 306 of cylindrical extension 290 and out holes 308 into the atmosphere.

Figure 22:
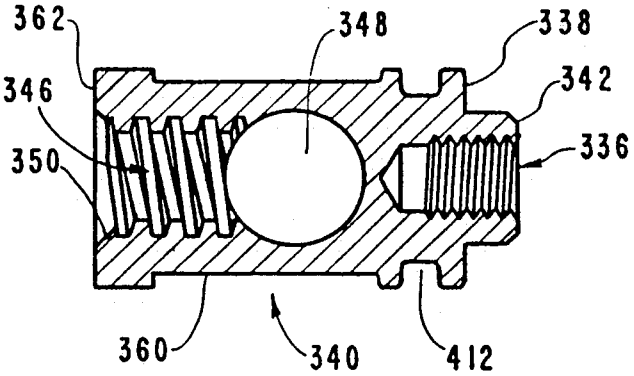
FIG. 22 is a top view of the worm sleeve of FIG. 21.
Figure 21:
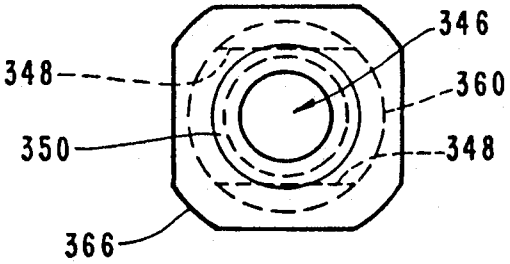
FIG. 21 is a longitudinal cross-sectional view of the worm sleeve.
Figure 23:
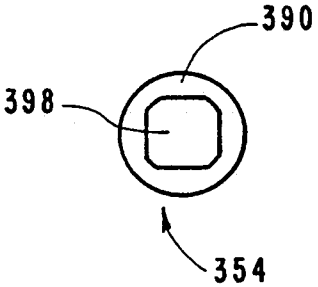
FIG. 23 is a top view of the worm stem.

Referring to FIG. 5, operating mechanism 212 is positioned in top chamber 220. Top wall segment 224 of housing 214 and the front end of separating wall 216 form cylindrical top chamber 220, which has a bevelled inside front rim (344). Top chamber 220 has front cylindrical chamber part 330, middle cylindrical chamber part 332 and back cylindrical chamber part 334. The threaded back end of operating rod 196 is screwed into internally threaded bore 336 in extended portion (342) located in the front (338) of worm sleeve 340. See FIGS. 21 and 22. Worm sleeve 346 has internally threaded back bore 346 which terminates in vertical cross bore 348. The top inside rim of back bore 346 is bevelled (350). Externally threaded front end 352 of worm stem 354 screws into back bore 346 of worm sleeve 346. O-ring gland 412 is located just below top surface 338. O-ring 360 is located in O-ring gland 412. Indented portion 360 comprises the predominant portion of the side surface of worm sleeve 340. Back wall 362 of worm sleeve 340 is generally flat and has a square cross-section with angled or bevelled corners 364.

Figure 24:
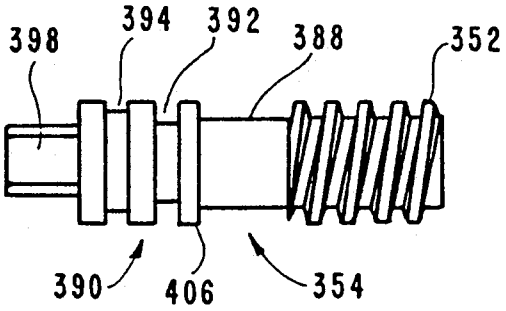
FIG. 24 is a longitudinal cross-sectional view of the worm stem of FIG. 23.

Top wall set 224, traversing it from front to back, slants inward to form bevel 334, continues across flat portion 366, continues vertically at 368 and then extends horizontally (370) to back wall 238. In about the middle of flat portion 366 there is raised portion 372 which internally has a top flat wall and two flat side walls. Separating wall, in traversing it from front to back, is horizontal (246), slants downward (230) and continues horizontally (228) back to wall 238. Circular passageway 374 is located in back wall 238 between separating wall 216 and top wall segment 224. Circular passageway 374 is internally threaded. Stem bushing nut 376 is cylindrical, is externally threaded on its lower portion (378), and has top hexagonal portion 380 (for insertion and removal). Stem bushing nut 376 is screwed into passageway 374. Central bore 382 in stem bushing nut 376 has back portion 384 and narrower front portion 386. Referring to FIG. 24, the center portion of worm stem 354 has cylindrical shaft 388 and expanded cylindrical portion 390. Cylindrical portion 390 contains groove 392 and O-ring gland 394. O-ring 396 fits in O-ring gland 394 and provides a seal even when worm stem 354 is being turned (rotated). Square-shaped back extension 398 of worm stem 354 is used for turning (rotating) worm stem 354. Flat rim 400 is formed between chamber 332 and 334. At least the top portion rim area of bottom surface 402 of retainer seal 358 contacts flat rim 400. Center passageway 404 of retainer seal 358 fits around section 406 of cylindrical portion 390 of worm stem 354. Disc bore 408 is formed by rim 410 of retainer seal 358. Rim 410 contacts the bottom surface of stem bushing nut 376. "C"-shaped thrust washer 356 is positioned in disc bore 408 and fits in groove 392 of worm stem 354.

In FIGS. 1, 2 and 4, plunger 178 and operating mechanism 212 are shown in the open or water flowing position. Plunger head 186 is not in passageway 122. Back surface 362 of worm sleeve 340 is in contact with front surface 402 of retainer seal 358. O-ring 360 fits against the wall of chamber 330. To effect the closed or water draining position, knob portion 390 is used to rotate worm stem 354 (O-ring 396 and thrust washer 356 freely turn). This turning action moves worm sleeve 340 towards the front so that it is mainly in chamber 330 with O-ring 360 in chamber 218. Referring to FIG. 5, the forward movement of worm sleeve 340 cannot go beyond 412 (formed by the intersection of slanted wall segment 230 and the flat surfaces to the rear thereof) as rim 414 is stopped by 412. This serves to protect the cartridge from damage due to moving rod 196 too far towards the front. The moving of worm sleeve 340 causes movement of plunger 178 via rod 196. Plunger head 186 moves into chamber 122, blocking any water flow from the water source. The plug is removed from drain port 176. The water retained in extender 104, chamber 218, plunger 178, etc., drains out of drain port 176 via drain holes 132 located in drain channel 130. See FIG. 3.

Roll pin 124 retains plunger 176 in casing 108. The pulling on rod 196 brings plunger 176 into contact with roll pin 124, allowing removal of cartridge 106.

The O-rings used in the invention hydrant are made of any conventional resilient material, such as, neoprene rubber.

The invention has a number of advantages. The factory-assembled cartridge is replaceable with the hydrant bottom valve remaining in place without disturbing piping connections and using common hand tools which are commonly available in most homeowners' tool boxes. The drain ports in cartridge sleeve are 180 degrees apart, opening into a channel on the outside diameter of the sleeve which allows transmission of the water in two directions toward and into the outer valve body drain port. This results in at least one of the sleeve drain ports being no further than 90 degree angular orientation from the outer valve body drain port. This assures quicker and more positive water drainage, even if silt, sand or scale build-up is present in one sleeve drain port. It is also more advantageous to use more than two drain ports uniformly spaced around the cartridge sleeve. The flow-through plunger design requires no side bypass ports while maintaining equal or greater cross-sectional flow area, resulting in lower system head loss. The plunger/sleeve bore seal arrangement results in extremely low operating forces required by the operating lever or screw mechanism. This will greatly extend the life of the operating mechanism due to lighter surface bearing loads on the screw threads or cam surfaces. The valve cartridge replacement allows all of the moving sealing surfaces to be replaced in one step as a unit without removal of the bottom valve body. The sharp-edged wiping/scrubbing rings molded on the outside surfaces of the sleeve serve to scrub the valve body bore(s). This is accomplished by: (1) rotating the cartridge by turning the operating rod prior to removal, which scrubs the scale and silt from the valve body walls; and (2) the circumferential rings scrub and wipe the scale from the bore surfaces during the cartridge removal. This scrubbing/wiping action prepares the bore(s) sealing surfaces for the installation and seal of the new cartridge.

What is claimed is:

1. Process for replacing a cartridge in a housing of a freeze proof hydrant, comprising the steps of:
   (a) urging a plunger within the cartridge against a roller pin lodged in the cartridge;
   (b) deforming a first end of the cartridge away from a ridge in the housing;
   (c) sliding the cartridge out of the housing;
   (d) deforming the first end of a replacement cartridge;
   (e) sliding the replacement cartridge into place within the housing; and
   (f) expanding the first end of the replacement cartridge to capture the ridge in the housing.

2. The process of claim 1 wherein the steps of deforming are carried out by contracting a diameter of the first end of the replacement cartridge to enable the replacement cartridge to slide through a constricted passageway in said housing.

3. The process of claim 2 wherein the steps of sliding are carried out by sliding the contracted first end of the replacement cartridge through a constricted passageway.

4. The process of claim 3 wherein the step of expanding further comprises the steps of moving the contracted first end of the replacement cartridge past the constricted passageway and allowing the deformed replacement cartridge first end to expand.

5. The process of claim 4 wherein the first end of the cartridge has at least one finger which each contains an enlarged portion which engages an end of the ridge.

6. The process of claim 1 wherein step (d) of deforming is carried out by contracting a diameter of the first end of the replacement cartridge to enable the replacement cartridge to slide through a constricted passageway in said housing.

7. The process of claim 6 wherein step (e) of sliding is carried out by sliding the contracted first end of the replacement cartridge through a constricted passageway.

8. The process of claim 7 wherein step (f) of expanding further comprises the steps of moving the contracted first end of the replacement cartridge past the constricted passageway and allowing the deformed first end of the replacement cartridge to expand.

9. The process of claim 8 wherein the first end of the replacement cartridge has at least one finger which each contains an enlarged portion which engages an end of the ridge.

10. Process of replacing a removable cartridge in a freeze-proof hydrant with another of such removable cartridges, said freeze-proof hydrant comprising:

(a) a housing having first and second ends, the first end having fitting means adapted for flow communication with a source of liquid under pressure;

(b) passageway in housing (a) for flow of the liquid from the first end to the second end of housing (a);

(c) back flow preventer means located in passageway (b);

(d) drain means in housing (a);

(e) a removable cartridge located in passageway (b) between back flow preventer means (c) and the first end of housing (a), comprising:

(i) a casing having a first end and a second end;

(ii) a passageway in casing (i) which provides an opening in the first end of casing (i) and an opening in the second end of casing (i);

(iii) drain means in casing (i) comprising a drain channel and at least one hole in the drain channel which extends through casing (i);

(iv) means for retaining removable cartridge in passageway (b);

(v) plunger means in passageway (ii) which can be moved from an open or liquid flowing position to a closed or liquid draining position, and vice versa, the plunger means having a plunger head which blocks passageway (ii) in the closed position and which allows liquid flow in passageway (ii) in the open position, the plunger means having a body to which the plunger head is connected, the plunger body having at least one passageway (vi) therethrough which provides communication between each end of passageway (ii) for liquid flow, the plunger means blocking drain means (d) and drain means (ii) when in the open position, and there being communication between drain means (ii) and drain means (d) when the plunger means is in the closed position, the plunger not having any passageway which communicates between passageway (vi) and the portion of the plunger facing the interior surface of passageway (ii), and (f) valve operating means, located in housing (a) so as not to block the liquid flow in passageway (v), whereby plunger means can be moved between the open position and the closed position, said process comprising the steps of:

(A) urging plunger means (v) within removable cartridge (e) against means for removal situated in passageway (ii) in the casing (i) of removable cartridge (e);

(B) deforming retaining means (iv) of removable cartridge (e) away from a ridge in passageway (b) in housing (a);

(C) sliding removable cartridge (e) out of housing (a);

(D) deforming retaining means (iv) of said another of said removable cartridges (e);

(E) sliding said another of said removable cartridges into place within housing (a); and (F) expanding retaining means (iv) of said another of said removable cartridges (e) to capture the ridge in housing (a).

11. The process of claim 10 where the urging plunger means against means for removal situated in passageway (ii) is done with sufficient force to overcome the means for retaining (iv).

* * * * *